US007080762B1

(12) United States Patent
Schwartz et al.

(10) Patent No.: US 7,080,762 B1
(45) Date of Patent: Jul. 25, 2006

(54) LEATHER SOFTENING APPARATUS FOR BASEBALL GLOVES

(75) Inventors: Dave Schwartz, River Edge, NJ (US); William Harms, River Vale, NJ (US)

(73) Assignee: Glovebuster, LLC, River Edge, NJ (US)

( * ) Notice: Subject to any disclaimer, the term of this patent is extended or adjusted under 35 U.S.C. 154(b) by 96 days.

(21) Appl. No.: 10/710,479

(22) Filed: Jul. 14, 2004

(51) Int. Cl.
*A41D 19/04* (2006.01)

(52) U.S. Cl. ..... 223/78

(58) Field of Classification Search ..... 223/78, 223/79, 80, 52
See application file for complete search history.

(56) References Cited

U.S. PATENT DOCUMENTS 915,465 A * 3/1909 McBride ..... 223/79
1,636,234 A * 7/1927 Klopsteg ..... 434/302
4,036,415 A * 7/1977 Filko et al. ..... 223/40
4,753,442 A * 6/1988 Bland ..... 473/424
5,421,493 A * 6/1995 Ebeling, II ..... 223/78
5,547,114 A * 8/1996 Mitchell ..... 223/78
5,638,999 A * 6/1997 Greene ..... 223/78
5,758,805 A * 6/1998 Dunn ..... 223/78
5,810,215 A * 9/1998 Plymell ..... 223/78
6,006,962 A * 12/1999 Ebeling, II ..... 223/78
6,019,259 A * 2/2000 Staniecki ..... 223/80
6,138,879 A * 10/2000 Breuner ..... 223/78

* cited by examiner

*Primary Examiner*—Danny Worrell
(74) *Attorney, Agent, or Firm*—Richard A. Joel, Esq.

(57) ABSTRACT

An apparatus for softening or "breaking-in" the leather on baseball and softball gloves comprises a cabinet having a hinged cover with a concave center portion of a gum-type rubber. A mushroom shaped ball head extends upwardly from the cabinet surface to engage a glove held in place by the domed cover surface. The ball head rotates and orbits about a bent shaft at a high speed and engages the pocket or other portion of a leather glove. The ball head softens the glove by physical contact as well as friction-induced heat.

7 Claims, 3 Drawing Sheets

10
11
12
14
15
17
18
20
23
24
24
26
32
33

17
12
20
10
15
23
33
32
24
26
11
14
13
28

LEATHER SOFTENING APPARATUS FOR BASEBALL GLOVES

BACKGROUND OF INVENTION

This invention relates to an apparatus for breaking in softening baseball or softball gloves. When manufactured, the leather gloves are generally stiff and unsuitable for use. Gloves are broken-in over a period of time through use until a glove becomes pliable and easy to handle. There is a need for an efficient and economical apparatus to condition gloves to make them pliable and easy to open and close in order to make catching a ball easier.

The prior art includes U.S. Pat. No. 5,547,114 to Mitchell which discloses a holding arm on which a glove is mounted, the holder being in semblance to the human hand and an air operated cylinder unit including an impact member carried at a working end of the cylinder rod to strike the palm part of the glove thereby softening the leather of the palm part. This action is done repeatedly until a softened pocket is formed in the glove palm.

U.S. Pat. No. 6,019,259 to Staniecki, discloses a hand member adapted to fit inside a new baseball or softball glove and a mechanical apparatus for causing a repetitive movement of the glove while the hand member remains therein. The thumb piece is pivotally connected to the rest of the hand about a pivot axis to stimulate the catching movement of the human hand. The mechanical apparatus has a pair of upwardly projecting arms. One of the arms is coupled to the drive mechanism to oscillate toward and away from the other arm. In use, the glove flexing apparatus causes the glove to flex between open and closed positions to soften the leather.

Also of interest are U.S. Pat. No. 915,465 to McBride, U.S. Pat. No. 4,753,442 to Bland, U.S. Pat. No. 4,036,415 to Filko, and U.S. Pat. No. 1,636,234 to Klopsteg.

The invention represents an improvement over the above patents in providing an economical and efficient apparatus to break-in baseball gloves in a short period of time.

SUMMARY OF INVENTION

The apparatus of this invention is designed to soften and break-in the leather of any type of leather or leather type glove particularly baseball and softball gloves.

A freely spinning metal mushroom shaped ball head rotates and orbits at a fast rate driven by an electric motor. The motor is mounted in a cabinet with a drive shaft extending upwardly through the cabinet. A ball head is rotationally mounted with a coupling on the top of the shaft. At a set distance immediately below the ball head, the shaft is machine bent at an angle to induce rotation of the ball head at angles designed to engage and break-in a glove. The ball head is constantly in contact with a selected part of the glove while in motion. A pivotal lid on the cabinet presses the glove against the ball head. In addition to physical contact by the ball head, friction induced heat helps to soften and mold the leather. Controls are provided to adjust the apparatus timing in accordance with the portion of the glove being softened and the degree of softness being imparted.

Accordingly, it is an object of this invention to provide a new and improved apparatus for breaking-in leather baseball or softball gloves.

Another object of this invention is to provide a new and improved apparatus to soften the leather on sports gloves in an efficient and controlled manner.

A further object of this invention is to provide a new and improved apparatus for breaking-in baseball gloves and the like with a free spinning rotating mushroom shaped ball head on an eccentric shaft which is in constant forced engagement with the glove.

A more specific object of this invention is to provide a new and improved method and apparatus for rapidly softening particular parts of a baseball glove and the like to a predetermined softness using a freely rotatable mushroom shaped "ball" coupled to a motor driven eccentric shaft and in constant contact with the glove within a housing.

BRIEF DESCRIPTION OF DRAWINGS

The above and other objects of this invention may be more clearly seen when viewed in conjunction with the accompanying drawings wherein.

FIG. 2 is a front view of the apparatus cabinet with the lid closed; and.

DETAILED DESCRIPTION

Figure 1:
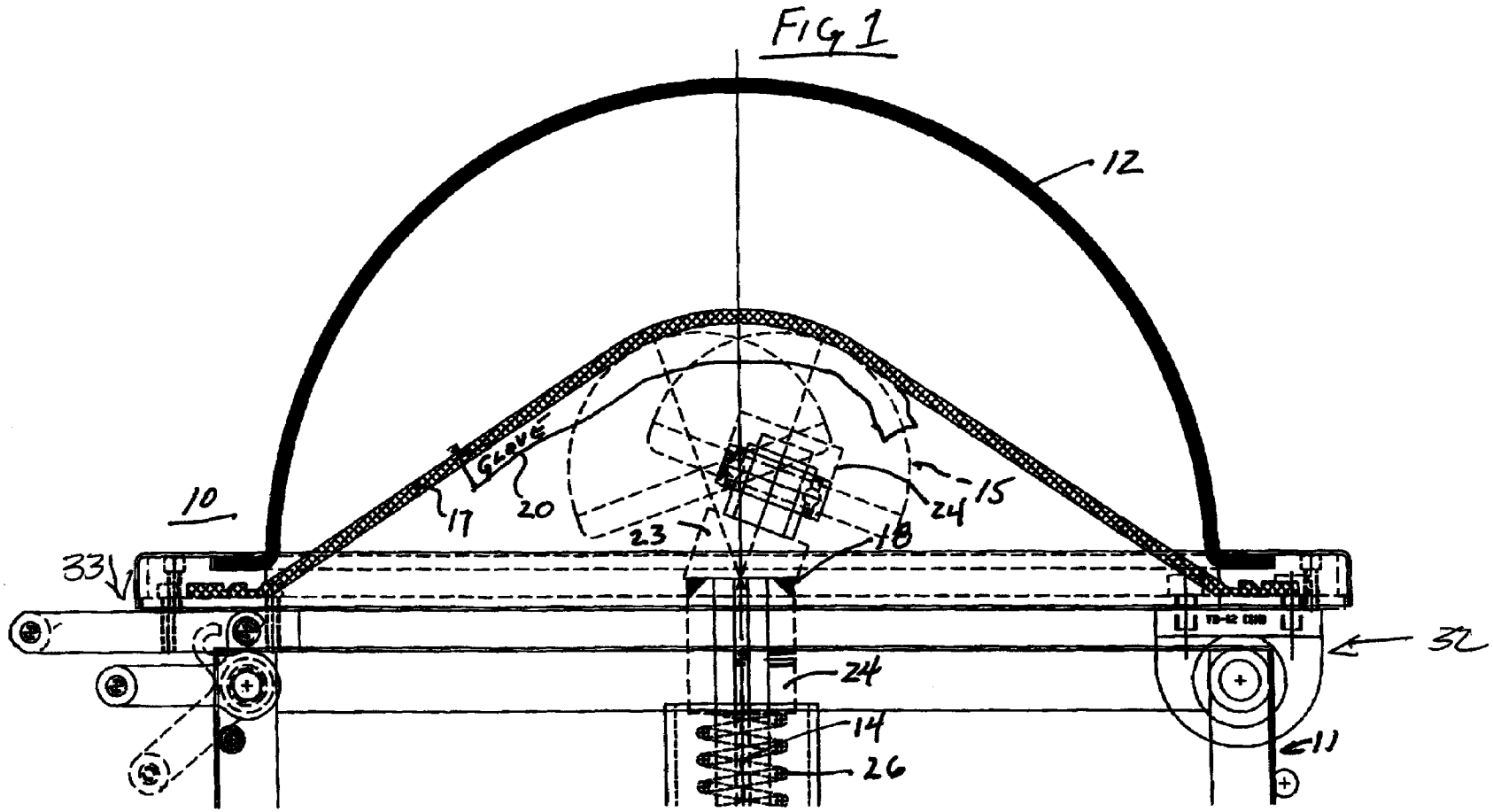
FIG. 1 is a schematic drawing of the mushroom shaped ball head, shown in phantom, in different positions in engagement with the glove.
Figure 2:
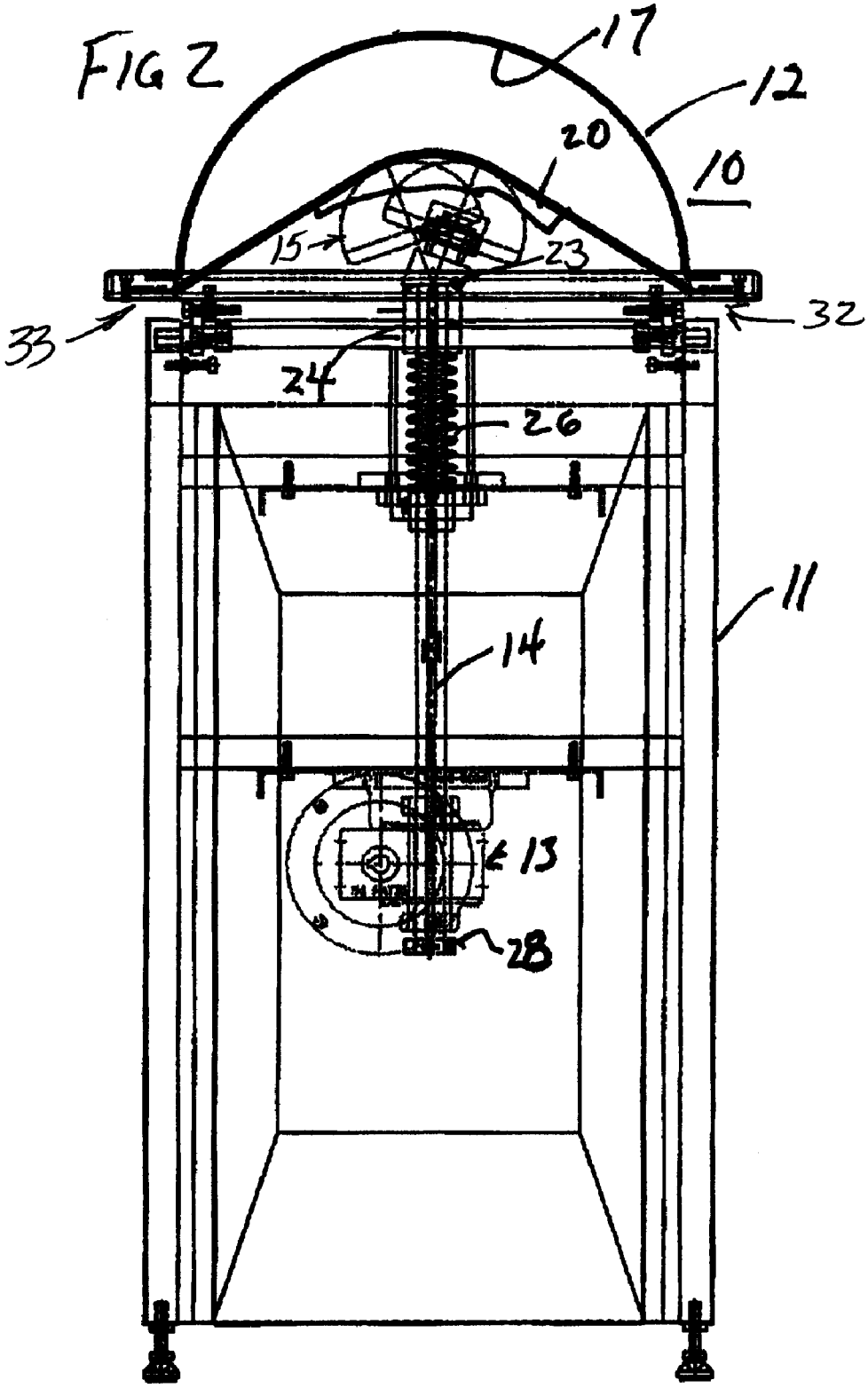
Figure 3:
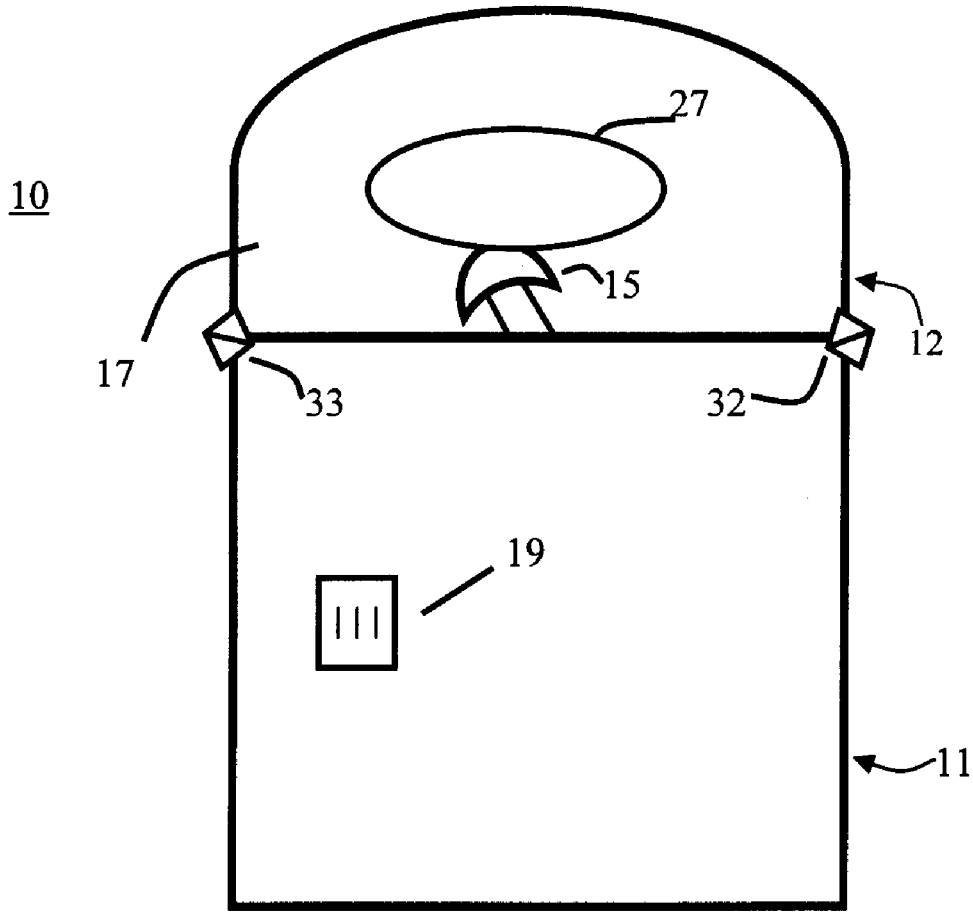
FIG. 3 is a front schematic view of the cabinet with the lid open.

Referring now to FIG. 1 of the drawings, the invention comprises a leather softening apparatus 10 for baseball and softball gloves 20, known commercially at the "Glove Buster". The apparatus 10 comprises a cabinet 11 with a pivotal lid 12, housing a motor 13 having a drive shaft 14 coupled thereto through gears 28. A mushroom shaped ball head 15 is rotatably mounted on the end of the shaft 14 with coupling 24. The shaft 14 is machine bent at an angle just below the ball head 15 at point 18 or includes an angled coupling 23. This angle is designed to induce rotation of the ball head 15 in a pattern, shown in phantom, in order to engage and break-in a glove 20. The shaft 14 is typically driven by a 3½HP motor and includes a support 24 and engaging springs 26 to provide a resilient backing to the angled *glove-engaging* portion 23.

The ball head 15 is in constant contact with a designated portion of the glove 20 when in motion. The glove 20 is initially positioned with the pocket 16 or other glove portion engaging the ball head 15 and the lid 12 closed forcing the glove 20 against the ball head 15. The hinges 32 and lock 33 secure the lid in place. The lid 12 has a concave elastomeric inner surface 17 with a recess 27 to accommodate the glove 20. In addition to the physical contact, friction induced heat helps to soften and mold the leather.

A control panel 19 is provided on the front face 21 of the cabinet 11. The panel 19 includes a timer coupled to the motor 13 which controls the amount of time each part of the glove 20 will be softened. Particular settings are selected for the pocket, web, heel, break and thumb. Another factor is the degree of softness required which ranges as follows: 1-stiff; 2-not as stiff; 3-average; 4-above average soft; 5-soft, game ready.

In operation, a glove 20 is positioned on the ball head 15 with the particular operative portion of the glove in engagement therewith. If necessary, a glove softener or oil may be applied to the glove 20. The lid 12 is closed forcing the ball head 15 and glove 20 firmly together. The desired control setting is activated and the ball head 15 moves eccentrically in engagement with the glove as shown in phantom while the freely spinning head rotates with the shaft 14. The ball head

15 contact and friction induced heat softens the glove 20 to the extent programmed and in the particular area selected. At the preselected time, the lid 12 is opened and the glove 20 removed. Another glove 20 may then be placed in the cabinet 11 on the ball head 15.

While the invention has been explained by a detailed description of certain specific embodiments, it is understood that various modifications and substitutions can be made in any of them within the scope of the appended claims, which are intended also to include equivalents of such embodiments.

The invention claimed is:

1. An apparatus for softening leather on baseball gloves comprising:

drive means;

an upwardly extending drive shaft having a lower end portion coupled to the drive means and an upper end portion positioned at an angle from the axis of the drive shaft;

a ball head having a convex outer surface and a concave internal portion rotatably mounted on the upper end portion of the drive shaft;

means forcing a predetermined portion of the glove into engagement with the outer surface of the ball head; and, means activating the drive means to rotate the ball head eccentrically in engagement with the glove to soften the leather.

2. An apparatus for softening leather in accordance with claim 1 further including:

a timer coupled to the drive means to control the degree of softness to be imparted to the glove.

3. An apparatus for softening leather in accordance with claim 2 further including:

a cabinet having the apparatus mounted therein, said cabinet having an upper surface with the ball head extending upwardly therefrom and a pivotal lid enclosing the upper cabinet surface, said lid having a concave inner surface to force a predetermined portion of the glove into engagement with the ball head.

4. An apparatus for softening leather in accordance with claim 3 wherein:

the concave inner surface of the lid comprises an elastomeric material.

5. An apparatus for softening leather in accordance with claim 1 further including:

a spring-loaded coupling having the upper angle portion of the drive shaft mounted thereto, said coupling being further being mounted to the shaft.

6. An apparatus for softening leather in accordance with claim 5 further including:

a coupling mounted within the inner portion of the ball head to permit rotation of said ball head about the coupling, said coupling being mounted to the upper angled portion of the drive shaft.

7. An apparatus for softening leather in accordance with claim 1 where:

the ball head includes a convex outer surface having a mushroom configuration, said ball head freely spinning on the angled portion of the shaft.

* * * * *